United States Patent [19]

Pescher

[11] Patent Number: 4,819,507

[45] Date of Patent: Apr. 11, 1989

[54] DEVICE FOR SIMULTANEOUSLY DRIVING THE SCREWS OF TWO PARALLEL SCREW-AND-NUT SYSTEMS

[75] Inventor: Michel Pescher, Ferrieres en Gatinais, France

[73] Assignee: Societe Redex, France

[21] Appl. No.: 184,577

[22] Filed: Apr. 21, 1988

[51] Int. Cl.[4] ..... F16H 37/06; B21B 31/24

[52] U.S. Cl. ..... 74/665 GA; 74/665 Q; 74/675; 72/248

[58] Field of Search ..... 74/665 Q, 665 GA, 665 P, 74/766, 675, 89.15; 72/248, 249

[56] References Cited

U.S. PATENT DOCUMENTS 3,373,635 3/1968 Meurer ..... 74/665 GA
3,626,737 12/1971 Defontenay ..... 72/249 X
3,992,915 11/1976 Hermes et al. ..... 72/249 X
4,470,284 9/1984 Noé et al. ..... 74/675 X
4,584,903 4/1986 Hirt et al. ..... 74/675

*Primary Examiner*—Dirk Wright
*Assistant Examiner*—Christopher Campbell
*Attorney, Agent, or Firm*—Gerald J. Ferguson, Jr.

[57] ABSTRACT

The invention relates to a device for clamping the rolls (5 and 6) of a rolling mill. It comprises two screw-and-nut systems (1 and 2) controlled by two epicyclic planetary gear trains (7 and 8) coupled to each other and to a first motor (18) for controlling the screws in opposite directions via a respective one of their two sun shafts (9 and 10), and coupled to each other and the gear wheel of a motor (13) for screwing or unscrewing the two screws in the same direction via their planet carriers (7*e*, 8*e*).

7 Claims, 1 Drawing Sheet

DEVICE FOR SIMULTANEOUSLY DRIVING THE SCREWS OF TWO PARALLEL SCREW-AND-NUT SYSTEMS

BACKGROUND OF THE INVENTION

There exist numerous mechanical devices which require simultaneous and parallel displacement of two points through the same amplitude. This applies, in particular, to top rolls in a rolling mill which must be moved parallel to themselves along fixed axes in order to take account of the thicknesses of sheet metal to be obtained and in order to ensure that said thicknesses correspond to set values. Rolls must also be capable of being tilted in order to adjust thickness or to overcome variations in thickness from one edge to another of a rolled strip. It is known that a strip which is thinner along one edge than the other by virtue of the metal being clamped more tightly at one axial end of the rolls in the mill presents a "long edge" on said side and this needs to be eliminated quickly by suitably tilting the top rolls.

These prior devices are essentially of two types, namely: hydraulic systems of the actuator type with hydraulic chambers being fed from servo-valves controlled by electronic servo-control circuits; or else mechanical systems (screw-and-nut systems, wheel and endless screw systems, . . . ) in which each of the systems is driven by a separate motor with the desired servo-control being obtained by an electronic system coupling the motors.

The drawbacks of such prior devices lie in their complexity, in the need for a high level of maintenance, in reliability which depends on the reliability of the electronic components, and in very high cost.

The present invention seeks to remedy these drawbacks by proposing robust mechanical equipment which is simple and which avoids the need for expensive, fragile and complex servocontrol, while nevertheless being easily controlled either manually or automatically or by a combination of both.

SUMMARY OF THE INVENTION

To this end, the present invention provides a device for simultaneously driving the two screws of two parallel fixed-nut screw-and-nut systems in equal amplitude translation in the same direction or in opposite directions, the device comprising two planetary gear trains each having two sun wheels, and each having an outlet coupled to a respective one of the two screws, wherein each screw is coupled to rotate with one of the sun wheels of the corresponding planetary gear train, with the planet carrier of each of the planetary gear trains being coupled to the outlet shaft of a first motor in such a manner as to provide equal amplitude and same-direction rotation, and with the other sun wheel of the planetary gear trains being coupled to each other to rotate through the same amplitude in opposite directions under the effect of a second motor for driving one of them.

In a preferred embodiment, the axes of rotation of the sun wheels, of the planet carriers, and of the drive motors are parallel to one another and to the screws, with the coupling between each of the planet carriers and the shaft of the first motor being provided by means of identical toothed wheels carried by each planet carrier and meshing with a gear wheel fixed to the shaft of the first motor, while the coupling between the two shafts of the said other sun wheels being provided by meshing between two identical toothed wheels fixed to each of said shafts, with one of said identical toothed wheels being driven by meshing with a gear wheel fixed to the shaft of the second motor.

Each planetary gear train is carried by the screw to which it is coupled. During opposite-direction displacement of the screws, in order to avoid losing meshing between the toothed wheels providing coupling between the planet carriers themselves, between the planet carriers and the corresponding motor, and between the wheels coupling the other planetary shafts, each wheel and gear wheel involved in said couplings is of sufficient thickness to take account of the differences in height of the gear trains.

Advantageously, use will be made of planetary trains whose coaxial sun shafts are also concentric.

Finally, each of the motors used may be controlled either manually by an operator or else automatically in a rolling mill as a function of parameters measured from the sheet leaving the rolling mill. It may be observed that the main advantage of the device in accordance with the invention lies in the complete decoupling between the command for displacing the screw ends in the same direction, and the opposite-direction command of said ends which is symmetrical relative to a fixed point. This gives rise to an extremely simple servocontrol system which is much more reliable than those that have been used heretofore.

BRIEF DESCRIPTION OF THE DRAWING

An embodiment of the invention is described by way of example with reference to the accompanying drawing, in which.

MORE DETAILED DESCRIPTION

Figure 1:
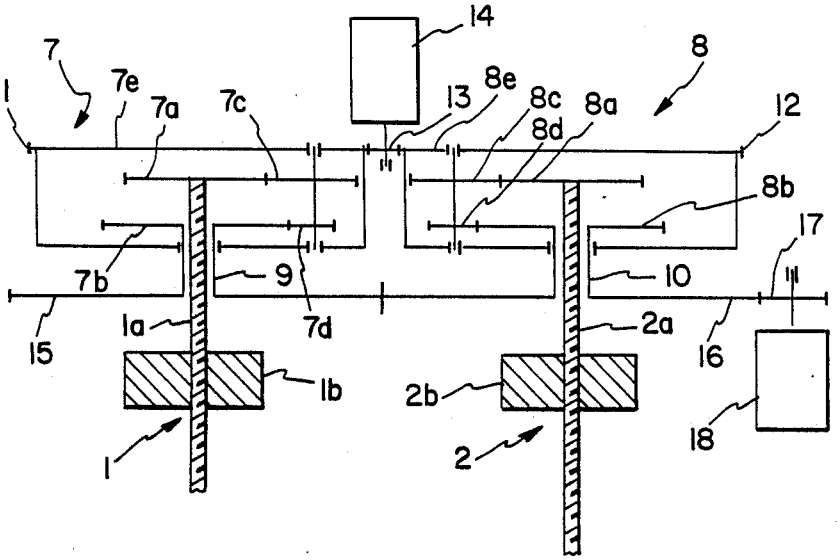
FIG. 1 is a diagram of a device in accordance with the invention.
Figure 2:
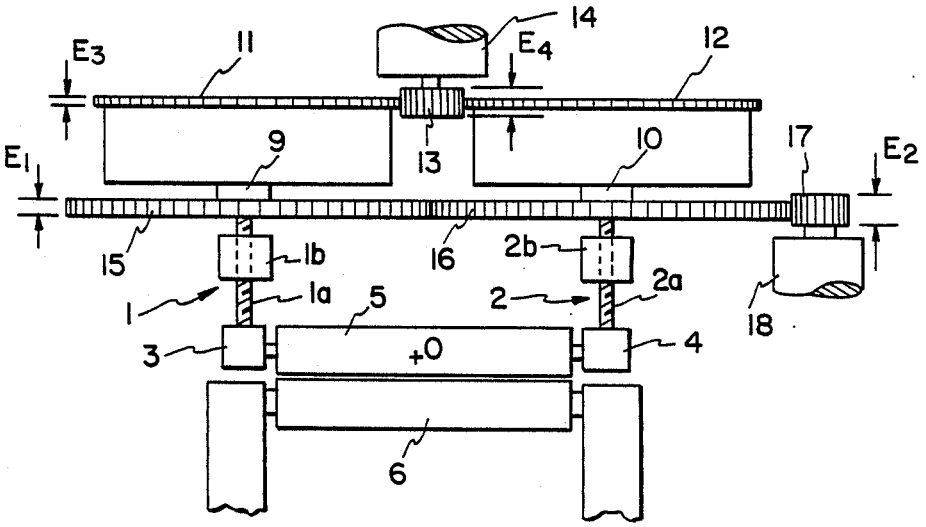
FIG. 2 illustrates the application of said device to providing clamping in a rolling mill.

With reference to the figures, two parallel screw-and-nut systems 1 and 2 can be seen, with each screw 1*a* and 2*a* rotating in a corresponding fixed nut 1*b* and 2*b* belonging to a frame (not shown). It can be seen in FIG. 2, that the ends of the screws 1*a* and 2*a* are coupled to bearings 3 and 4 which are vertically movable in a frame (not shown) and which support the top roll 5 of a rolling mill whose bottom roll 6 rotates about a fixed axis. It can thus be seen that by screwing or unscrewing the screws 1*a* and 2*a* in the nuts 1*b* and 2*b*, the bearings 3 and 4 are displaced. The screws are assumed to be of the same size and to have the same pitch, such that simultaneous screwing or unscrewing thereof through the same amplitude causes the roll 5 to move parallel to itself. In contrast, screwing only one of them while simultaneously unscrewing the other through the same amplitude causes the roll 5 to pivot about an axis O running through the middle of the roll perpendicularly to its axis of rotation.

Each of the screws 1*a* and 2*a* is coupled to one of the sun wheels 7*a* or 8*a* of a corresponding planetary gear train 7 or 8 having two sun wheels. The other sun wheels are referenced 7*b* and 8*b*, and the planet wheels are referenced 7*c*, 7*d*, 8*c* and 8*d*, and they are carried by planet carriers 7*e* and 8*e*. The planetary trains 7 and 8 have the special feature of their sun wheel shafts being concentric. Thus one of the sun shafts is constituted by the screws 1*a* or 2*a* and the other sun shaft coupled to the wheels 7*b* and 8*b* is constituted by a sleeve 9 or 10 which surrounds the screw. These special gear trains are known and have been sold for many years by the French Firm REDEX as an epicyclic or a differential module.

When used in accordance with the invention, each planet carrier 7*e* or 8*e* of a differential module is fitted with an identical toothed wheel 11 or 12 which co-operates directly with an outlet gear wheel 13 of a motor and step-down gear unit 14. In addition, each sun shaft sleeve 9 or 10 is fitted with an identical toothed wheel 15 or 16 which meshes with the other toothed wheel 16 or 15, and with one of these wheels, in this case wheel 16, being driven by the outlet gear wheel 17 of a second motor or motor and step-down gear unit 18.

The device in accordance with the invention operates as follows:

When the two screws 1*a* and 2*a* are to be screwed simultaneously in the nuts 1*b* and 2*b*, the gear wheel 13 is caused to rotate in the appropriate direction by powering the motor unit 14. This rotation causes the two planet carriers 7*e* and 8*e* to rotate in the same direction. Since the unit 18 is unpowered, the gear wheel 17 is stationary as are the wheels 15 and 16 and the corresponding sun wheels 7*b* and 8*b*. Under these conditions, rotation of the planet carrier 7*e*, 8*e* causes the sun wheel 7*a* and 8*a* to rotate giving rise to corresponding screwing or unscrewing of the screws 1*a* and 2*a* in their nuts, with said operations taking place at the same speed and thus at the same amplitude as can be shown by simple calculation. In the application shown in FIG. 2, this causes the roll 5 to move parallel to itself relative to the roll 6. It will be understood that simple servo-control of the position of the roll 5 relative to the roll 6 can be obtained using a sensor for sensing the thickness of the rolled product being obtained.

However, if it is necessary to adjust the inclination of the axis of the roll 5 relative to the roll 6, for example to correct a long edge along metal strip, the motor 18 may be rotated in one direction or the other, since when it rotates its outlet wheel 17 causes the wheels 15 and 16 to rotate in opposite directions. Assuming that the planet carriers 7*e* and 8*e* are prevented from rotating, then rotation of the wheels 15 and 16, and thus of the sun wheels 7*b* and 8*b*, gives rise to rotation of the sun wheels 7*a* and 8*a* with a step-down ratio which is defined by the step-down ratio firstly between the wheels 7*b*, 7*d*, or 8*b*, 8*d* and secondly between the wheels 7*c*, 7*a* or 8*c*, 8*a*. The screws are thus caused to rotate in opposite directions with one of them screwing by the same amplitude as the other one of them unscrews, as can also be shown by calculation. In this case, the roll 15 pivots about an axis centered on O in FIG. 2. At this point, the thickness (or the distance) between the two rolls is conserved as defined by the first servo-controlled adjustment using the motor 14. Use of the motor 18 therefore gives rise to differential rocking of the clamping between the rolls about a predetermined average value because of the mechanical independence of the two screw-controlling motors. It is recalled that this could not be obtained in the prior art where adjusting the inclination of the top roll gives rise to a reaction on the thickness adjustment. It can thus be seen that complex servo-control is required to obtain an appropriate reaction when varying one or other of the monitored parameters (thickness or long edge, for example), can thus be seen.

In contrast, with the present invention, there is no need to couple the motor 14 and the motor 18 in order to obtain a fully satisfactory device. The motor 18 may, for example, be controlled by an operator who visually monitors the product coming from the rolling mill and who causes clamping corrections to be applied as a function of the quality of the product as perceived by the operator. Simultaneously, the motor 14 is controlled by a measuring apparatus which compares the real thickness of the product with the reference thickness value. Servo-control may also be provided for the motor 18 by using sensors to detect a difference in thickness occuring at the edges of the product, with said difference being maintained in the vicinity of a zero over a given range of tolerance.

Finally, it may be observed that the amplitudes of the displacements when performing adjusting by means of the motor 18 are very small. Since, by construction, the gear trains 7 and 8 are supported solely by the screws 1*a* and 2*a*, a vertical offset may occur between them when the motor 18 is used. In order to avoid a loss of meshing between the gear wheels and the toothed wheels, it is necessary to ensure that the various thicknesses $E_1$, $E_2$, $E_3$, and $E_4$ of these members are always sufficient to ensure that the teeth always mesh over an adequate length for properly transmitting the torques involved. The motors 14 and 18 could alternatively be fixed to a frame with the assemblies 7 and 8 moving vertically relative thereto. In this case, the gear wheels 13 and 17 need to have toothed lengths $E_2$ and $E_4$ which are sufficient (in the axial direction) to ensure that they mesh at all times with the wheels which are axially displaceable by virtue of the two possible motions of the screws (together or in opposite directions). The motors may also be supported on a frame which moves together with the point O of the roll 5.

The invention is applicable throughout the field of mechanical construction, and in particular in rolling mills.

I claim:

1. A device for simultaneously driving the two screws of two parallel fixed-nut, screw-and-nut systems in equal amplitude translation in the same direction or in opposite directions, the device comprising two planetary gear trains each having two sun wheels and each having an outlet coupled to respective one of the two screws, wherein each screw is coupled to rotate with one of the sun wheels of the corresponding planetary gear train, with the planet carrier of each of them being coupled to the outlet shaft of a first motor in such a manner as to provide equal amplitude and same-direction rotation, and with the other sun wheels of the planetary gear trains being coupled to each other to rotate through the same amplitude in opposite directions under the effect of a second motor for driving one of them.

2. A device according to claim 1, wherein the axes of rotation of the sun wheels, of the planet carriers, and of the drive motors are parallel to one another and to the screws, with the coupling between each of the planet carriers and the shaft of the first motor being provided by means of identical toothed wheels carried by each planet carrier and meshing with a gear wheel fixed to the shaft of the first motor, while the coupling between the two shafts of the said other sun wheels being provided by meshing between two identical toothed wheels fixed to each of said shafts, with one of said identical toothed wheels being driven by meshing with a gear wheel fixed to the shaft of the second motor.

3. A device according to claim 2, wherein each planetary gear train is supported by the screw to which it is coupled, with the thicknesses of the above-mentioned toothed wheels and gear wheels being sufficient to allow a difference of amplitude to occur between the two gear trains without losing meshing.

4. A device according to claim 1, wherein each planetary gear train is an epicyclic train having concentric sun shafts.

5. A device according to claim 1, wherein each of the abovementioned screws is fixed at its other end to a corresponding bearing of the movable top roll of a rolling mill assembly, thereby constituting a device for clamping said assembly.

6. A device according to claim 5, wherein the first motor is servo-controlled to the thickness of the rolled strip.

7. A device according to claim 5 or claim 6, wherein the second motor is under manual control.

* * * * *